United States Patent [19]

Ross

[11] Patent Number: 4,748,756

[45] Date of Patent: Jun. 7, 1988

[54] TOUCH ACTIVATED ENHANCED PICTURE FRAME

[76] Inventor: Bruce Ross, 8 Kiska Ct., Randallstown, Md. 21133

[21] Appl. No.: 6,176

[22] Filed: Jan. 23, 1987

[51] Int. Cl.[4] ..... A47G 1/06

[52] U.S. Cl. ..... 40/152.2; 40/455; 40/564

[58] Field of Search ..... 40/152.2, 442, 541, 40/553, 564, 455; 362/800, 135, 136, 253, 140; 323/904

[56] References Cited

U.S. PATENT DOCUMENTS

| | | | |
|---|---|---|---|
| 1,190,600 | 7/1916 | Shreves et al. | 40/152.2 |
| 2,588,545 | 3/1952 | Lawrence | 40/152.2 |
| 3,928,928 | 12/1975 | Kalust | 40/455 |
| 4,096,656 | 6/1978 | Diceglie | 40/564 |
| 4,286,399 | 9/1981 | Funahashi et al. | 40/124.1 |
| 4,299,041 | 11/1981 | Wilson | 40/124.1 |
| 4,531,310 | 7/1985 | Acson | 40/455 |
| 4,541,188 | 9/1985 | Sadorus | 40/455 |

OTHER PUBLICATIONS

Reynolds, P. R. G., Practical Electronics, "Ingenuity Unlimited", vol. 14, No. 5, Jan. 1978, p. 347.

*Primary Examiner*—Robert Peshock
*Assistant Examiner*—Cary E. Stone

[57] ABSTRACT

A picture frame enhanced with a light or sound generating device which is activated by a user touching a touch sensitive contact area that is incorporated as a part of the picture frame structure. Contact with the touch sensitve contact area is sensed by control circuitry which responds by activating and controlling the functioning of the light or sound enhancement.

5 Claims, 4 Drawing Sheets

TOUCH ACTIVATED ENHANCED PICTURE FRAME

BACKGROUND

1. Field of Invention

This invention relates to picture frames with enhancement of light and/or sound, specifically to a touch sensitive activating means for switching and controlling said enhancements.

2. Description of Prior Art

Heretofore, a wide variety of picture frame enhancements involving light and/or sound have been proposed. Modifying picture frames in this way has, for the most part, been commercially unsuccessful. This combination of devices has failed to provide sufficient novelty and uniqueness to catch the imagination and interest of the consuming public.

A problem with these combinations is that they lack spontaneity and surprise. That is, the user must be aware of a switch which will turn the device on and off and also how to operate said switch. Having to knowningly operate said switch virtually eliminates the possibility of being surprised.

Switches used in the past required that the user either manually turn off the enhancement or place it in the appropriate orientation such as resting it on its base or tilting it in the proper directon in order to turn the enhancement off. Enhanced picture frames with these types of switching devices are especially vulnerable to being left in the turned on state through forgetfulness, leaving the frame in the wrong orientation, or accidental tipping, bumping, or jarring of the picture frame. If batteries are used to power the enhancement battery life can be considerably shortened by the aforementioned problem.

No prior art references suggest the combination of a picture frame enhanced with light and/or sound and a touch sensitvie switch means and control circuitry means for sensing a user's touch and activating and controlling the enhancement. There is also no prior appreciation of the advantage and synergism which is inherent in the aforementioned combination. In addition, there is no prior art reference which suggests using the aforementioned combination wherein the enhancement is a plurality of light generating devices which to produce an attractive marquee like effect about a picture frame as will be shown in an embodiment below.

OBJECTS AND ADVANTAGES

Accordingly, an object and advantage of my invention is to provide, for the first time, a combination of a picture frame structure, an enhancement of light and/or sound, and a touch sensitive switch means and control circuitry means to sense a user's touch and activate and control the functioning of said enhancement as required. In this way, enhancements such as illumination, decorative light, music, voice synthesis, or recordings can be activated when the picture frame is normally handled by the user. The touch sensitive activating means incorporated in the structure of the enhanced picture frame is, therefore, the means through which an unsuspecting user obtains a surprising result. Once having been surprised, the user will naturally want to share the surprise and excitement with others. Thus, the touch activated enhanced picture frame has significant marketing advantage over picture frames without this feature.

Another object and advantage of the touch activated enhanced picture frame is to provide an automatic shut-off of the enhancement when the user discontinues handling the picture frame. The touch activated enhanced picture frame cannot be left turned on through forgetfulness, leaving the picture frame in the wrong orientation, or by accidentally being tipped, bumped or jarred. Thus, the possibility of accidentally discharging batteries is eliminated by this invention.

Another object and advantage of my invention is to provide the user with a pleasurable experience from the sense of response obtained by handling the touch activated enhanced picture frame. Picture frames without this feature are inanimate and provide no touch gratification.

Another object and advantage of my invention is that it creates a synergism. That is, the effect produced by combining a touch sensitive switch means and control circuitry means with an enhanced picture frame is greater than that of either component taken separately. This synergism adds significant novelty and uniqueness to the picture frame, thereby improving its consumer appeal and hence positively effecting its marketability.

Another object and advantage of one embodiment of my invention is an enhancement of light using a plurality of light emitting devices which provide a marquee effect. No prior art has heretofore suggested this combination nor recognized its attractive advantages.

Readers will find further objects and advantages of my invention from a consideration of the ensuing description and the accompanying drawings.

DRAWING FIGURES

DRAWING REFERENCE NUMERALS

Figure 1:
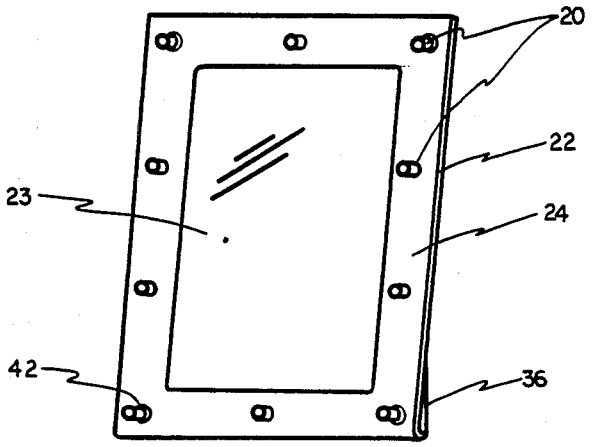
FIG. 1 shows a front perspective view of an embodiment of this invention wherein the enhancement is a plurality of light emitting diodes which produce a marquee effect.

20 Light emitting diodes (LED's)
22 Acrylic front panel
23 Picture
24 Foil hot stamp on rear of 22
26 Printed circuit board rear panel
28 Touch sensitive contact area on 26
29 Parallel copper runs on printed circuit board 26
30 Battery holder
32 Battery
34 Control circuitry
36 Base of 22
38 Thin foam pad
40 Hole in 22
42 LED mounting device
44 Metal mounting device
46 Glass or clear acrylic picture cover
48 Picture
49 Clip
50 Backing card
52 Battery
53 Adaptor jack with normally closed switch
54 Battery holder
56 Control circuitry
57 Fluorescent circuitry
58 Fluorescent bulb socket
60 Fluorescent bulb
62 Printed circuit board rear panel
64 Touch sensitive contact area on 62
66 Parallel copper runs on printed circuit board 62
67 Normally open pivoted switch plate
68 Stand support
70 Screw
72 Hole in printed circuit board 62
74 Alternating current to direct current adapter
76 Adapter plug

TOUCH ACTIVATED ENHANCED PICTURE FRAME--DESCRIPTION AND OPERATION

My invention can be embodied in many different forms. The following discussion will describe several such configurations.

Embodiment Using LED's

Figure 5:
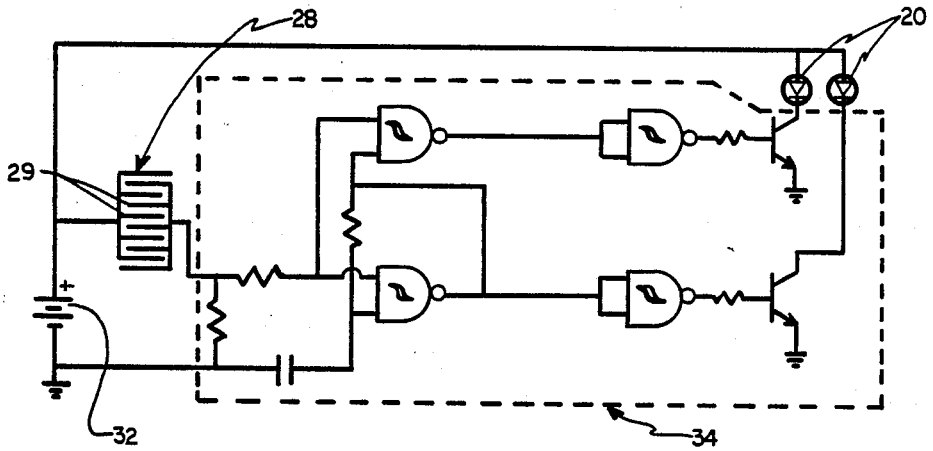
FIG. 5 is a diagram. showing an electronic circuit configuration which can be used in the embodiment of FIG. 1 through FIG. 4.

FIG. 1 shows one embodiment of the invention as a touch activated frame enhanced with a plurality of light emitting diodes 20 spaced about the acrylic front panel 22 so as to provide a marquee effect which is switched and controlled by the touch sensitive activating means of FIG. 5.

The picture frame comprises an acrylic front panel 22 which is bent so as to provide a base 36 for the frame. A hot stamped foil 24 is applied to the rear of the acrylic front panel 22 so as to provide an attractive, inexpensive matt for the picture 23.

Figure 2:
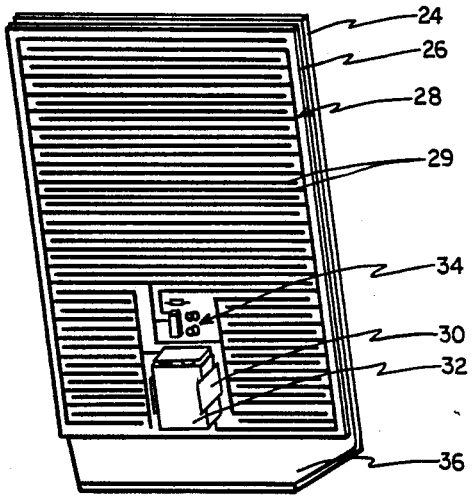
FIG. 2 shows a rear view of the embodiment of FIG. 1.

FIG. 2 shows a rear view of the picture frame and best displays the rear of the printed circuit board 26 consisting of a touch sensitive contact area 28, control circuitry 34, battery holder 30 and battery 32.

Figure 3:
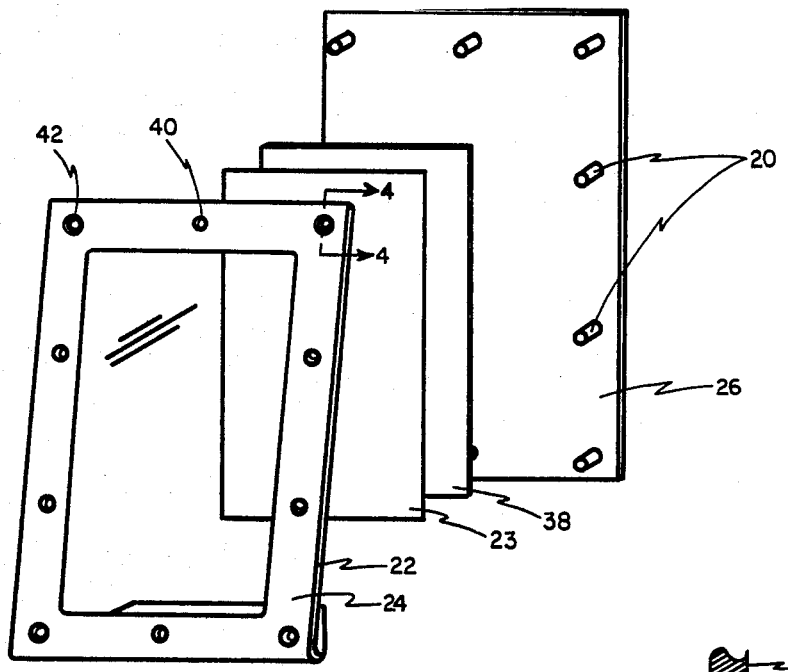
FIG. 3 shows an exploded front perspective view of the embodiment of FIG. 1.

FIG. 3 shows an exploded view of the relative positions of the acrylic front panel 22, the picture 23, and the thin foam pad 38 which is glued to the front side of the printed circuit board rear panel 26 for the purpose of holding and displaying the picture between the acrylic front panel 22 and the printed circuit board rear panel 26.

Figure 4:
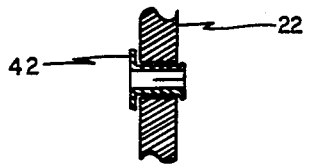
FIG. 4 shows a cross sectional view of a hole in the front panel of the embodiment of FIG. 1.

FIG. 4 shows a cross sectional view of one of the corner holes 40 in the acrylic front panel 22. The corner holes use a standard LED mounting device 42 which grips the LED's 20. This gripping action provides the necessary holding strength to keep the parts 22, 23, 26, and 38 shown in FIG. 3 held together in a sandwich or layered fashion. The LED mounting device 42 is designed to provide sufficient gripping strength to keep the parts of the frame 22, 23, 26, and 38 from falling apart during normal handling yet separate easily enough for picture 23 replacement.

FIG. 5 shows a schematic wiring diagram of the touch sensitive activating means and the enhancement of this embodiment. The touch sensitive activating means is comprised of control circuitry 34, battery 32 and the touch sensitive contact area 28. The enhancement is comprised of LED's 20.

The touch sensitive contact area 28 of FIG. 2 and FIG. 5 is a touch sensitive switch device comprised of parallel copper runs 29 on a printed circuit board 26. Each adjacent copper run 29 is an electrical contact of the switch.

During normal handling of the touch activated enhanced picture frame, the user's hands will contact the touch sensitive contact area 28 on the printed circuit board rear panel 26. The touch sensitive contact area 28 is comprised of parallel copper runs 29 on the printed circuit board rear panel 26. These parallel copper runs 29 are designed to be sufficiently closely spaced so that a user's skin touching anywhere in the touch sensitive contact area 28 will easily bridge the gap between at least two adjacent parallel copper runs 29 which are switch contacts. The user's skin then is a conducting path between two adjacent parallel copper runs 29 and thereby elecrtrically connects the switch contacts.

The conducting path created by the user's skin is sensed by the control circuitry 34 which responds by turning on the enhancement. If the user discontinues touching the touch sensitive contact area 28, the conducting path is removed. The control circuitry 34 senses the removal of the conducting path between adjacent parallel copper runs 29 and responds by turning off the enhancement.

FIG. 5 shows a schematic wiring diagram of the control circuitry 34, battery 32, touch sensitive contact area 28, parallel copper runs 29 which are switch contacts and LED's 20. This particular circuit uses two input NAND gates with Schmitt--trigger action on both inputs. In addition to sensing a conducting path between the parallel copper runs 29 and switching the enhancement on and off, the control circuitry 34 also causes the LED's 20 to blink alternately producing a marquee effect about the picture 23.

The control circuitry 34 shown in FIG. 5 is one of many possible circuit configurations which can perform the aforementioned functions.

Embodiment Using Fluorescent Light Bulbs

Figure 6:
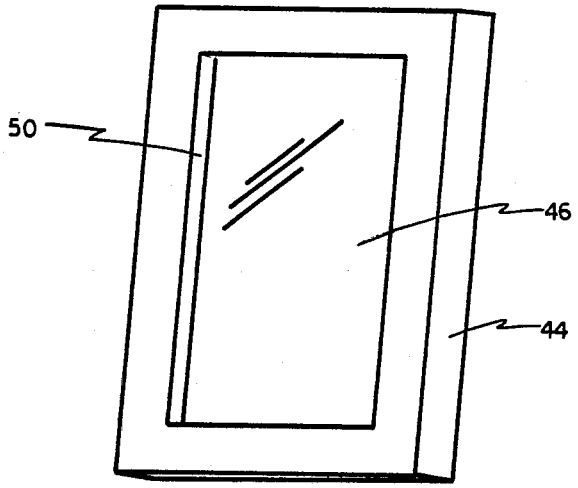
FIG. 6 shows a front perspective view of an embodiment of this invention wherein the enhancement uses fluorescent light bulbs.

FIG. 6 shows another embodiment of my invention as a touch activated picture frame enhanced with fluorescent light bulbs 60. The enhancement of this embodiment of the touch activated enhanced picture frame is used for both decoration and utility.

Figure 8:
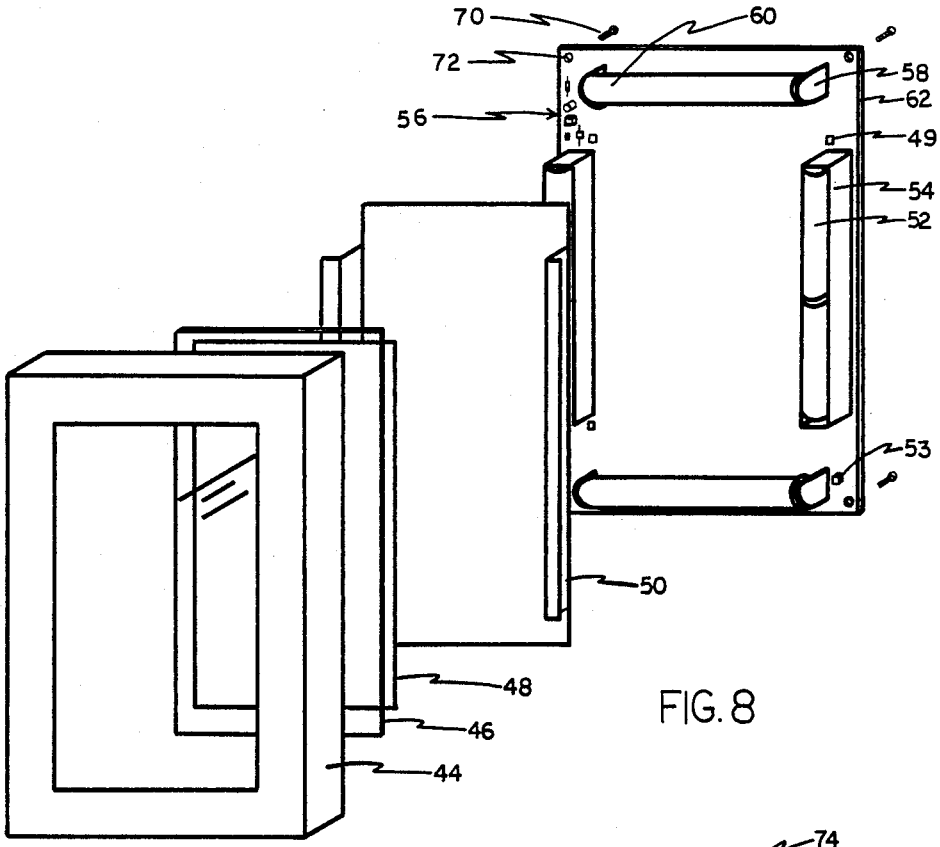
FIG. 8 shows an exploded front perspective view of the embodiment of FIG. 6.

FIG. 8 shows the metal front panel 44 and the backing card 50 which conceal the batteries 52, battery holders 54, fluorescent bulbs 60, fluorescent bulb sockets 58, and control circuitry 56 inside of the frame. The picture 48 is held in place by compression between the glass or clear acrylic picture cover 46 and the backing card 50. The glass or clear acrylic picture cover 46 is held in place by four clips 49 attached to the front of the printed circuit board 62.

Figure 7:
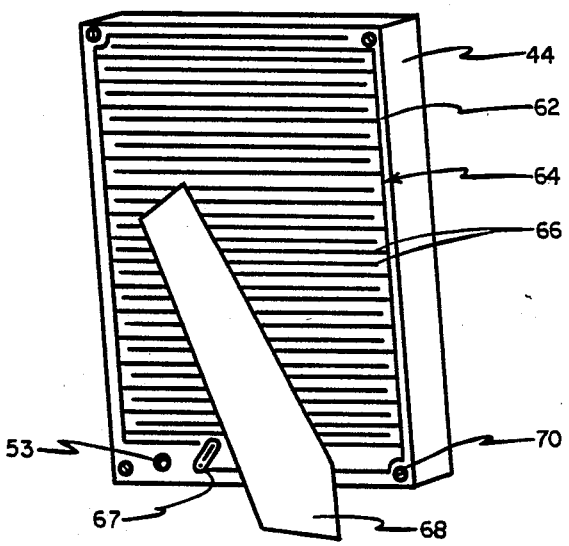
FIG. 7 shows a rear view of the embodiment of FIG. 6.

Four screws 70 fit through the four holes 72 in the printed circuit board 62 and thread into metal tabs at the rear of the metal front panel 44 so as to hold the parts of the frame together as shown in FIG. 6 and FIG. 7. The stand support 68 of FIG. 7 is similar to support stands commonly found on picture frames and is affixed at its hinged end to the rear of the printed circuit board 62.

Figure 9:
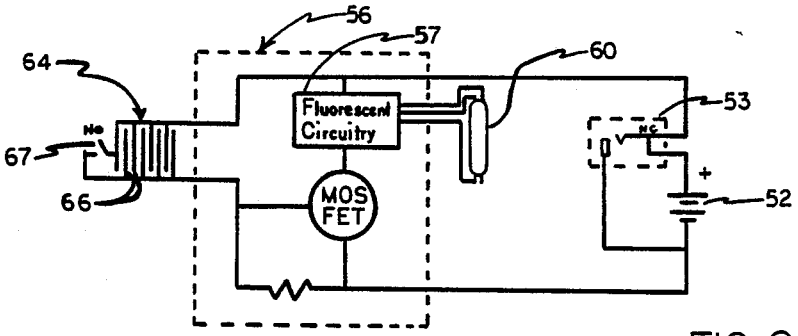
FIG. 9 is a diagram showing an electronic circuit configuration which can be used in the embodiment of FIG. 6 through FIG. 8.

FIG. 9 shows a schematic wiring diagram of the touch sensitive activating means and the enhancement of this embodiment. The touch sensitive activating means is comprised of control circuitry 56, battery 52, and the touch sensitive contact area 64. The enhancement is comprised of fluorescent bulbs 60. The fluorescent circuitry 57 used in the control circuitry 56 is similar to that commonly used for starting and running fluorescent bulbs energized from direct current energy sources.

The construction and operation of the touch sensitive contact area is virtually identical to that of the previously described embodiment using LED's. The control circuitry 56 differs in that this embodiment uses a power MOSFET instead of a NAND gate with Schmitt--trigger to sense the presence of a conducting path between two adjacent parallel copper runs 66 on the touch sensitive contact area 64. The power MOSFET turns the fluorescent circuitry 57 either on or off depending on the presence or absense of a conducting path created by the user touching the touch sensitive contact area 64.

The control circuitry 56 shown in FIG. 9 is one of many possible circuit configurations which can perform the aforementioned functions.

Figure 10:
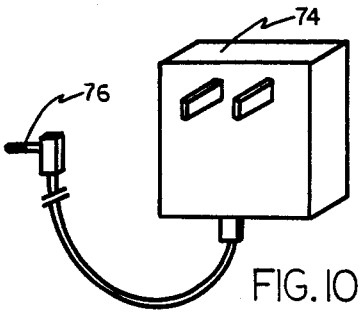
FIG. 10 shows a conventional alternating current to direct current adapter which can be used in the embodiment of FIG. 6 through FIG. 9.

FIG. 7 shows an adapter jack with normally closed switch 53 which is used with the adapter plug 76 of the alternating current to direct current adapter 74 of FIG. 10 as a means for eliminating the need for batteries 52. The adapter jack with normally closed switch 53 is shown in the schematic wiring diagram of FIG. 9 wherein the "NC" designation means normally closed when the adapter plug 76 is not inserted.

FIG. 7 also shows a normally open pivoted switch plate 67 which is used to switch the enhancement on for continuous operation when the alternating current to direct current adapter 74 is connected. A conducting path between two parallel adjacent copper runs 66 on the printed circuit board 62 can be created by rotating the normally open pivoted switch plate 67. The normally open pivoted switch plate 67 is shown in the schematic wiring diagram of FIG. 9 wherein the "NO" designation means normally open.

Embodiment Using Sound

The aforementioned embodiments demonstrate several ways in which light can be used as one type of enhancement in this invention. These embodiments could have also included sound generating devices such as electronic music, voice synthesis, and recorder sound devices. Sound generating devices can also be used as enhancements by themselves. Embodiments of this invention are not limited by any particular combination of light and/or sound.

CONCLUSION, RAMIFICATIONS AND SCOPE OF INVENTION

Thus, the reader will see that the touch activated enhanced picture frame invention provides surprise, enjoyment, touch gratification, decoration, function and utility which can be appreciated by persons of almost any age.

While the above description contains many specificities, the reader should not construe these as limitations on the scope of the invention, but merely as exemplifications of preferred embodiments thereof. Those skilled in the art will envision many other possible variations within its scope. For example, skilled artisans will readily be able to change the dimensions and shapes of the various embodiments. They will also be able to make the touch activated enhanced picture frame of alternative materials such as metal, plastic and wood. They can make many variations and/or substitutions in the touch sensitive contact area, e.g., they can change the switch contact points from the rear panel to the front panel or have one contact on the front panel and one on the rear panel. They can change the control circuitry. They can substitute thermal, capacitive, or optical type sensors for the touch sensitive contact area. They can change the number and/or types of lights and the effects they produce. They can use sound generating devices as enhancements.

Accordingly, the reader is requested to determine the scope of the invention by the appended claims and their legal equivalents, and not by the examples which have been given.

I claim:

1. A touch activated enhanced picture frame comprising:

a picture frame structure comprising a front panel, rear panel, stand support and means for holding and displaying a picture between said front panel and said rear panel, a light enhancement means incorporated in said picture frame structure for providing additional visual appeal, a touch sensitive switch means incorporated in said picture frame structure having a touch sensitive contact area for sensing a user's touch, a control circuitry means incorporated in said picture frame structure and interconnected to said touch sensitive switch means and said light enhancement means for activating and controlling said light enhancement in response to a user's touch.

2. The picture frame of claim 1 wherein said touch sensitive contact area is comprised of electrical contacts.

3. The picture frame of claim 1 wherein said light enhancement means is a plurality of light generating devices spread about the perimeter of said front panel whereby said light generting devices produce a pleasing marquee effect when activated by said control circuitry.

4. A touch activated enhanced picture frame comprising:

a picture frame structure comprising a front panel, rear panel, stand support and means for holding and displaying a picture between said front panel and said rear panel, a sound enhancement means incorporated in said picture frame structure for providing audible appeal, a touch sensitive switch means incorporated in said picture frame structure having a touch sensitive contact area for sensing a user's touch, a control circuitry means incorporated in said picture frame structure and interconnected to said touch sensitive switch means and said sound enhancement. means for activating and controlling said sound enhancement in response to a user's touch.

5. The picture frame of claim 4 wherein said touch sensitive contact area is comprised of electrical contacts.

* * * * *